United States Patent [19]

Miller

[11] 3,943,670

[45] Mar. 16, 1976

[54] ANCHOR SYSTEM FOR MOBILE HOMES AND SIMILAR STRUCTURES

[76] Inventor: Milton J. Miller, 39 Greenway Drive, Goshen, Ind. 46526

[22] Filed: May 28, 1974

[21] Appl. No.: 473,914

[52] U.S. Cl. ..... 52/23; 52/157; 52/710

[51] Int. Cl.[2] ..... E04H 9/14; E04H 12/20

[58] Field of Search..... 52/23, 155, 157; 24/68 CD; 248/361 R; 403/104, 166, 393

[56] References Cited

UNITED STATES PATENTS

| | | | |
|---|---|---|---|
| 384,481 | 6/1888 | Vanderwaag | 403/104 |
| 3,335,531 | 8/1967 | Grimelli | 52/23 |
| 3,371,902 | 3/1968 | Hartwick | 248/354 |
| 3,691,703 | 9/1972 | Barnes | 52/23 |
| 3,713,616 | 1/1973 | Bowers | 248/361 R |
| 3,734,443 | 5/1973 | Fukuda | 248/361 R |
| 3,744,192 | 7/1973 | Burnett | 52/23 |
| 3,747,288 | 7/1973 | Grimelii | 52/23 |

*Primary Examiner*—Frank L. Abbott
*Assistant Examiner*—William Randolph
*Attorney, Agent, or Firm*—Marmaduke Hobbs

[57] ABSTRACT

An anchoring system for mobile homes, trailers and similar vehicles in which a rod structure extending over the top of the vehicle is anchored on opposite sides of the vehicle and a resilient means is incorporated in the rod structure for maintaining tension on the rod structure to maintain the rod structure firmly in effective operating condition. A strap structure extending over the vehicle is anchored on opposite sides and beneath the vehicle, by anchoring devices held by a channel iron in runners or other supporting surfaces for the vehicle. Straps may also be connected to the frame and the anchoring device so that the vehicle is anchored over the top and at the frame by a dual type system.

7 Claims, 8 Drawing Figures

ANCHOR SYSTEM FOR MOBILE HOMES AND SIMILAR STRUCTURES

When mobile home campers and the like are set in place, they are usually not placed on and secured to a permanent foundation but are left on their undercarriages and sometimes placed on concrete blocks or on stabilizing jacks. In mobile home parks, concrete runners or slabs may be provided for the structures to give the undercarriage a firm footing. Since mobile homes and similar structures are relatively light in weight for their size, they are particularly vulnerable to high winds, often accompanying violent storms such as tornadoes, hurricanes, blizzards and thunder storms, and are relatively easily overturned or moved from their site and crushed or otherwise seriously damaged or destroyed. In order to combat this hazard, guy wires with turnbuckles have been used in the past to anchor the units down and prevent them from being blown from their sites. These guy wires have generally been unsatisfactory in that they have been difficult and time consuming to install and to tighten sufficiently to be dependable under most of the foregoing adverse conditions, and they often have become loose and ineffective. Attempts have been made to overcome the disadvantages of the conventional guy wires, straps and the like anchored to the ground on opposite sides of the vehicle; however, the means used to overcome these have had certain drawbacks, including difficulty in installing and tightening the wire and straps to prevent them from becoming loosened from the force of the wind. Further, the wires and straps themselves sometimes cause damage to the vehicle structure, particularly along the edge of the roof. It is therefore one of the principal objects of the present invention to provide an anchor structure for mobile homes, trailers, campers, modular homes and the like, which can be easily installed and which will maintain maximum effectiveness when the installation has been made, and even under conditions in which there is a tendency for the anchoring means to become loosened, either during a storm or high winds, or over a period of inattention and lack of service.

Another object of the invention is to provide an anchor system having members such as rods extending over the mobile home, which will automatically maintain tension on the members but which will not damage the edges of the roof, and which anchors the frame as well as the superstructure.

Still another object is to provide an anchoring structure of the aforesaid type which anchors both the frame and the superstructure, and which utilizes rods in combination with straps or wires and stabilizers to give maximum reliability and safety to the structure.

A further object is to provide an anchor device for mobile homes which can be installed either with the mobile home on or off runners or slabs, and which will remain trouble free for long periods of time and can be effectively adapted to a variety of different types and makes of units without changing the structure of the device.

Additional objects and advantages of the present anchor device will become apparent from the following description and accompanying drawings, wherein.

Figure 1:
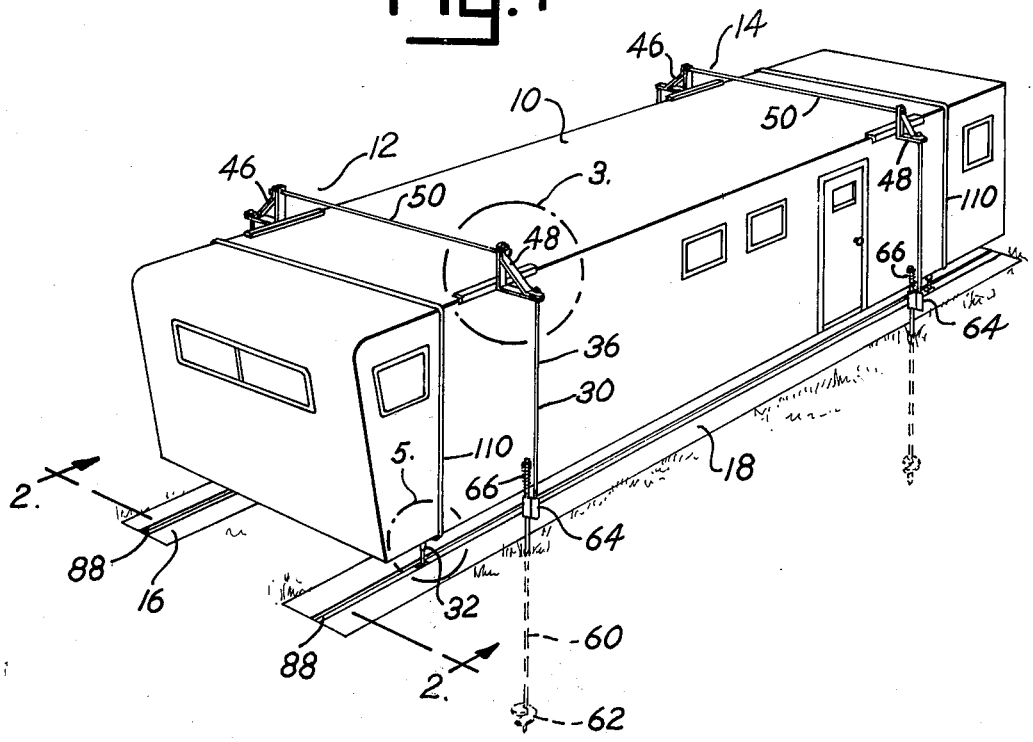
FIG. 1 is a perspective view of a mobile home showing the present anchor system installed thereon.
Figure 2:
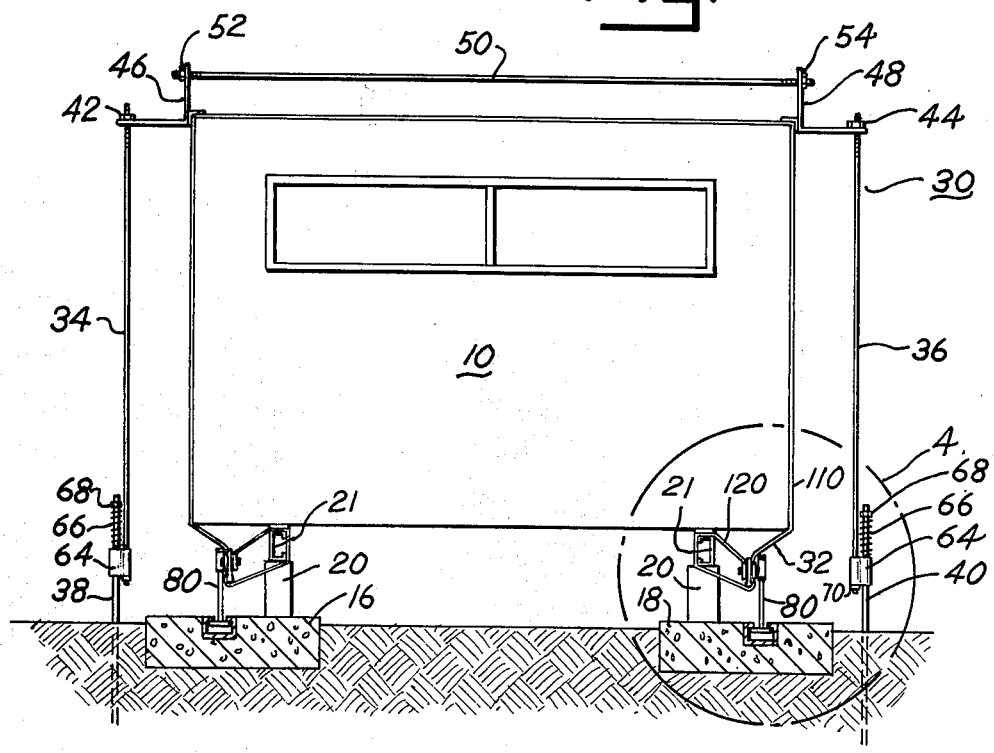
FIG. 2 is an end elevational view of the mobile home shown in FIG. 1, further illustrating the present anchoring system.
Figure 3:
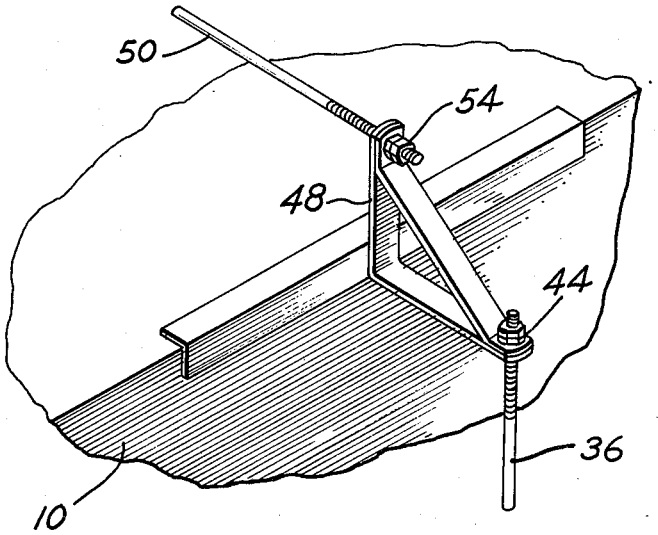
FIG. 3 is a perspective view of a part of the anchor system which extends over the edge of the roof.

Referring more specifically to the drawings and to FIG. 1 in particular, numeral 10 indicates generally a mobile home which for the purpose of the present application may be considered conventional. Numeral 12 indicates one section of the anchor system and numeral 14 another section of the anchor system, two sections of the anchor system being shown on the mobile home, although a different number may be used if required. The two sections are the same in construction and operation, and hence only one section of the system will be described herein. In some installations only one section may constitute the complete system. The mobile home is normally left on the undercarriage, which is rolled onto concrete runners 16 and 18, and blocks 20 or other stabilizing objects or devices which are normally placed between the ground or runner and a frame member of the mobile home, for example member 21, to give firmness to the mobile home while it is in use. The various other features of the mobile home, such as the doors and windows, may be of any suitable arrangement, and the present system is adapted to be used with a variety of different types and makes of mobile homes.

The basic system of the present mobile home anchoring device consists of two structures indicated generally by numerals 30 and 32. Numeral 30 is directed to a structure having a series of rods extending over the top of the unit and being anchored on opposite sides, and the unit 32 is directed to the anchoring straps extending over the top and being anchored beneath the unit. While it is preferable to use both anchoring structures, either of the two structures could be used separately if desired.

In the embodiment illustrated in the drawings, the anchor structure 30 consists of vertical rods 34 and 36 attached to anchor devices 38 and 40, respectively, the two anchor devices being essentially the same in structure and operation. The upper ends of rods 34 and 36 are connected by screw threads and nuts 42 and 44 to corner mounting brackets 46 and 48, which are connected by a rod 50 secured at opposite ends to the brackets by threads and nuts 52 and 54. The corner bracket projects beyond the edge of the roof of the mobile home and prevents it from being crushed or damaged by the installation and by high winds when the installation is functioning to protect the mobile home.

The anchor devices 38 and 40 shown in the drawings consist of a shaft or rod 60 having an auger 62 at the bottom thereof for inserting the anchor in the ground. The anchor devices are connected to the respective rods by a sleeve 64 which slips downwardly over the end of shaft 60, and a spring 66 reacts between the upper end of the sleeve and a nut 68 threaded onto the upper end of the shaft. The sleeve is preferably rigidly secured to the lower end of the respective rod 34 and 36, by a nut 70 threaded onto the lower end of the respective rod. The spring 66 with adjustment nut 68 applies a strong force downwardly against sleeve 64, holding the rods 34 and 36 firmly but yieldably in position at the upper end of the anchor devices 38 and 40. This spring is usually under compression, and in that condition, keeps tension on rods 34 and 36 even when the anchor devices may become slightly loosened, either through neglect or during a storm. The compression on spring 66 can be easily varied to satisfy conditions by further tightening nut 68.

Figure 4:
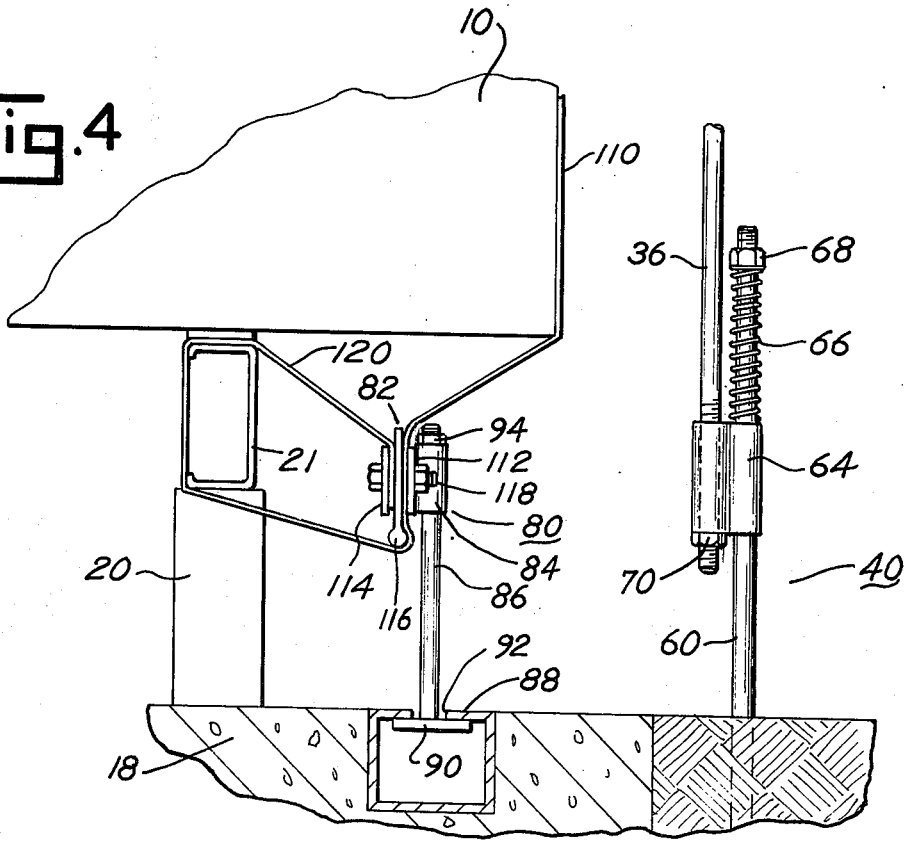
FIG. 4 is an enlarged fragmentary elevational view of the anchor system, showing the manner in which certain parts are installed.
Figure 5:
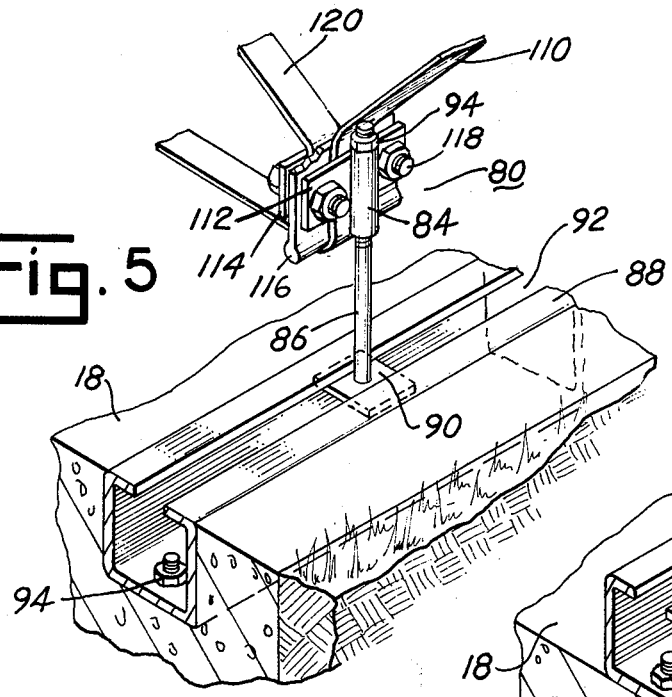
FIG. 5 is a perspective view of the parts of part of the anchor system, illustrating one form for anchoring the system.
Figure 6:
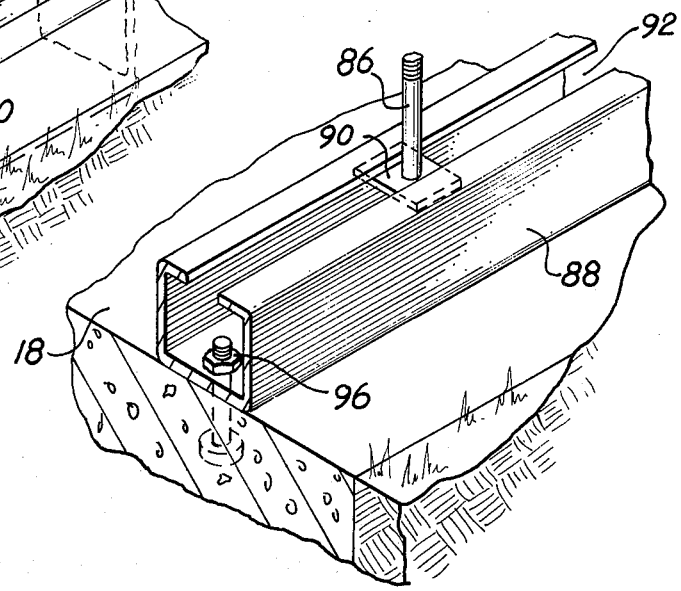
FIG. 6 is a perspective view of a portion of the anchor system, illustrating a further way of anchoring the system.
Figure 7:
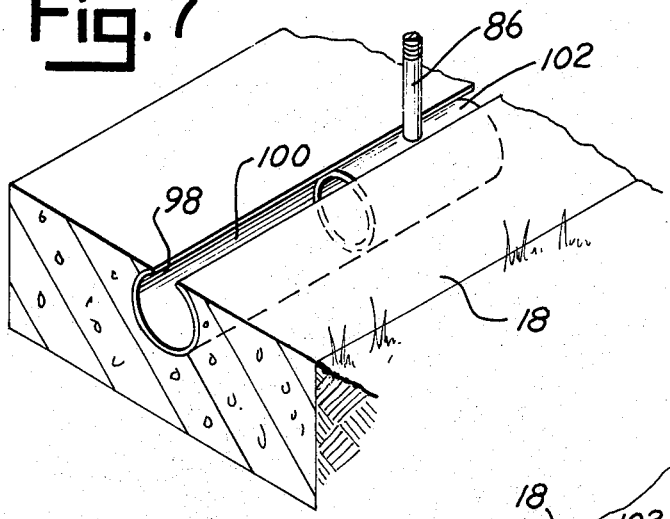
FIGS. 7 and 8 illustrate further ways of anchoring the present system.
Figure 8:
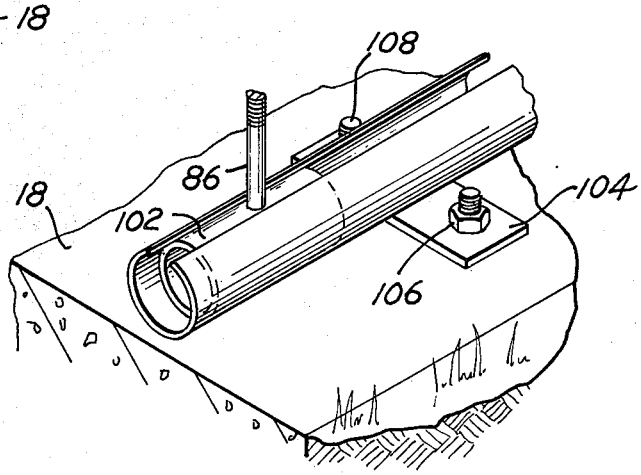

Anchor device 32 consists of a strap holding means 80 having a strap clamp 82 secured to a sleeve 84 mounted on rod 86, the rod being anchored, in the embodiment illustrated in FIG. 4, into a channel iron member 88 embedded in the concrete runner. A shoe 90 welded or otherwise secured to the bottom end of rod 86 engages the sides of the channel iron along slot 92 and retains the rod firmly in place after an installation has been made. The sleeve is held in place and adjusted as required by a nut 94 threaded onto the upper end of rod 86. The channel iron may be recessed in the runner and secured therein by a series of bolts and nuts 94, as illustrated in Figures, or it may be bolted onto the surface of the runner by bolts and nuts 96 as illustrated in FIG. 6. A further modification of the anchoring means is illustrated in FIGS. 7 and 8 in which a tubular member 98 having a slot 100 therein contains a sleeve 102 to which rod 86 is secured. The embodiment illustrated in FIG. 7 shows the tubular member embedded in the concrete with the exception of slot 100, and in the embodiment illustrated in FIG. 8, which is essentially the same as that shown in FIG. 7, the tubular member is mounted on top of the runner and secured thereto by a plurality of bars 104 retained in place by bolts 106 and 108.

The strap 110, which may be initially installed when the mobile home is under construction, extends over the top and down along the sides of the mobile home, either beneath the external sheeting or on the outside, and is secured by clamp 82 which consists of a plate 112 rigidly mounted on sleeve 84, and plates 114 and 116 secured to plate 112 by bolts 118.

Since the structure of some mobile homes above the basic frame is somewhat frail in construction, and hence does not form a firm reliable support for straps 110, it is preferable that the basic frame also be anchored separately from the structure thereabove. In the invention illustrated in the drawings, an extension 120 of strap 110 is looped around frame member 21 and thence back between plates 114 and 116 and between plates 116 and 112. After the strap is looped and placed between the plates, bolts 118 are tightened, thus clamping the lower end of strap 110 and simultaneously clamping the ends of extension 120 onto anchoring device 80. With the straps secured in this manner, both the superstructure and the frame are anchored firmly by anchor device 80 as it is held in place by shaft 86 and shoe 90 seated in channel member 88.

In the use and operation of the present anchoring system, the mobile home is placed on the runners above the channel members 88, for example, and anchor devices 80 are moved along the slot to place them in proper position for securing straps 110. The strap is then secured to the anchor device by clamping it between plates 112, 114 and 116, and simultaneously therewith the extension 120 is looped around the frame and clamped between the plates. The opposite ends of the strap 110 and a similar extension 120 are secured on the opposite side of the mobile home. In order to give maximum protection, the rod structure consisting of rods 34, 36, and 50 is installed first by inserting the augers in the ground and then securing the rods in place, using the mounting brackets 46 and 48 for connecting rods 34 and 50 and 36 and 50. The rods 34 and 36 are connected to anchoring devices 38 and 40, respectively, and nuts 68 on the two devices are tightened to compress springs 66 and apply the desired anchoring force.

In the event of a storm or other high wind, the mobile home is held firmly in place by the straps 110 and 120, and the rod system indicated generally by numeral 30. In the event the auger has become loose or the mobile home has settled, compressed spring 66 on each of the anchor devices 38 and 40 will take up the slack and continue to hold the system and the mobile home firmly in place. Further, if during the storm the rod structure tends to become somewhat loosened as a result of the force of the wind tugging at the mobile home and the anchor device, the spring will likewise take up the slack and maintain the system in effective condition for resisting the wind. The flexibility afforded by the springs also takes the shock from the rod structure, thus minimizing the tendency of the anchoring devices 38 and 40 to become loose or damage the mobile home structure.

While only one embodiment of the present anchoring system has been described in detail herein, various changes and modifications may be made without departing from the scope of the invention.

I claim:

1. An anchoring system for mobile homes, trailers and similar vehicles, comprising a first anchor device for each side of the vehicle, a series of rods extending over the body of the vehicle and being connected to said anchor devices, and a second anchor device having a vertical shaft for each side of the vehicle, a strap for extending over the body of the vehicle for connection with said second anchor devices, a means on said second anchor device for clamping said strap including a plurality of clamping plates, a sleeve supporting said plates and movable axially on said shaft, and means on said shaft for retaining said sleeve in an adjusted position.

2. An anchoring system for mobile homes, trailers and similar vehicles as defined in claim 1 in which a resilient connection is provided in said first anchor devices and rod series.

3. An anchoring system for mobile homes, trailers and similar vehicles as defined in claim 2 in which said first anchoring devices include a vertical rod and said resilient connection includes a sleeve interconnecting two rods and a coil spring on one of said rods urging the sleeve in the direction to place a tension on the rod system.

4. An anchoring system for mobile homes, trailers and similar vehicles as defined in claim 3 in which said resilient connection is mounted on the upper end of the rod of said first anchor devices.

5. An anchoring system for mobile homes, trailers and similar vehicles as defined in claim 1 in which a strap is connected to said second anchor device and a strap section is adapted to be connected to a basic frame member of the vehicle.

6. An anchoring system for mobile homes, trailers and similar vehicles as defined in claim 1 in which a longitudinally extending channel is adapted to be connected to a supporting structure for the vehicle and is provided with a slot, and said second anchoring device has a member extending into said slot for holding said anchor device in any selected position along said channel.

7. An anchoring system for mobile homes, trailers and similar vehicles as defined in claim 1 in which said second anchoring device includes a series of parallel plates for clamping the end of a strap disposed over the vehicle structure and means for clamping said plates and strap together to firmly hold the lower end of the strap.

* * * * *